US005722568A

United States Patent [19]

Smith

[11] Patent Number: 5,722,568

[45] Date of Patent: Mar. 3, 1998

[54] TAMPER-EVIDENT AEROSOL CAP

[75] Inventor: Jeremy Smith, Loudon, N.H.

[73] Assignee: Summit Packaging Systems, Inc., Manchester, N.H.

[21] Appl. No.: 712,619

[22] Filed: Sep. 13, 1996

[51] Int. Cl.[6] ..... B67D 5/32

[52] U.S. Cl. ..... 222/153.06; 222/182; 220/281

[58] Field of Search ..... 222/153.06, 182, 222/10; 220/724, 725, 281, 285; 215/224, 225, 253, 303–305, 295

[56] References Cited

U.S. PATENT DOCUMENTS

| | | | |
|---|---|---|---|
| 2,892,572 | 6/1959 | Fredette et al. . | |
| 2,980,299 | 4/1961 | Smith . | |
| 3,028,992 | 4/1962 | Bucher et al. . | |
| 3,128,004 | 4/1964 | Soffer . | |
| 3,170,602 | 2/1965 | Suellentrop et al. . | |
| 3,170,603 | 2/1965 | Kitterman . | |
| 3,180,532 | 4/1965 | Michel . | |
| 3,236,421 | 2/1966 | Glazier . | |
| 3,259,233 | 7/1966 | Beeman . | |
| 3,262,600 | 7/1966 | Gach . | |
| 3,414,167 | 12/1968 | Osrow . | |
| 3,480,184 | 11/1969 | Landis . | |
| 3,544,023 | 12/1970 | Henrickson et al. . | |
| 3,684,124 | 8/1972 | Song . | |
| 3,802,607 | 4/1974 | Mead . | |
| 3,854,622 | 12/1974 | McKirnan . | |
| 3,927,796 | 12/1975 | Whitehouse . | |
| 3,964,634 | 6/1976 | Jasinski et al. . | |
| 3,995,765 | 12/1976 | Burke . | |
| 4,326,649 | 4/1982 | Marino et al. . | |
| 4,728,007 | 3/1988 | Samuelson et al. | 222/182 |
| 4,738,375 | 4/1988 | Rosen et al. . | |
| 4,744,483 | 5/1988 | Hidding . | |
| 4,942,977 | 7/1990 | Hidding . | |
| 4,962,864 | 10/1990 | Appal et al. . | |

FOREIGN PATENT DOCUMENTS

| | | |
|---|---|---|
| 26 09 901 | 9/1977 | Germany . |
| 66 17 413 | 6/1967 | Netherlands . |

*Primary Examiner*—Philippe Derakshani
*Attorney, Agent, or Firm*—Davis and Bujold

[57] ABSTRACT

An improved overcap for an aerosol container comprising a top portion interconnected with an annular skirt via a sidewall to form a closed cap which is opened at one end thereof. The skirt contains a release mechanism which has a tab and a leg which, when the tab is biased in a first direction, functions as a fulcrum prying a portion of the overcap adjacent the release mechanism away from a mounting cup of an aerosol container thereby releasing the overcap from the mounting cup. An inwardly facing surface of the skirt contains a rib for engaging an outwardly facing surface of a mounting cup curl while the release mechanism contains a rib for engaging an inwardly facing surface of the mounting cup curl for maintaining the overcap in engagement with the mounting cup. The release mechanism is provided with a pair of frangible members which interconnect with the release mechanism with the overcap to indicate, when broken or fractured, tampering of an aerosol container incorporating the improved overcap.

15 Claims, 3 Drawing Sheets

TAMPER-EVIDENT AEROSOL CAP

FIELD OF THE INVENTION

This invention relates to a cap for an aerosol container, and more particularly, the invention relates to a cap which provides visual evidence of any tampering.

DESCRIPTION OF THE PRIOR ART

Aerosol containers contain a valve member on their top surface. In order to protect the valve from accidentally activating, an overcap is placed over the valve. The overcap usually snaps over the mounting cup supporting the valve.

Tampering with aerosol containers has become a major problem in recent years. A number of states have passed or are considering requiring manufacturers to employ tamper-proof or tamper-evident closures on aerosol products. The known tamper-proof systems currently available suffer a number of deficiencies. The most common deficiencies are that the containers are difficult to open or that the evidence of tampering is not readily apparent at the time of purchase. In addition, the prior art overcaps are not easily removable from the aerosol container and are generally sometimes difficult to re-attach to the aerosol container.

SUMMARY OF THE INVENTION

Wherefore, it is an object of the present invention to overcome the aforementioned problems and drawbacks associated with the prior art designs.

A further object of the invention is to manufacture an overcap which is relatively easy and inexpensive to manufacture.

Another object of the invention is to manufacture an overcap which facilitates repeated re-attachment of the overcap to the aerosol container as well as repeated removal of the overcap therefrom.

Yet another object of the invention is to provide an overcap which is securely attached to the aerosol container during shipment and readily indicates any tampering of the aerosol container prior to sale.

Another object of the invention is to provide an overcap release mechanism which is easy to operate and facilitates removal of the overcap from the aerosol container with minimal effort.

A still further object of the invention is to provide an overcap which mounts to both an inner portion and an outer portion of a mounting cup to securely attach the overcap to an aerosol container.

These and other objects of the invention will be further understood with reference to the accompanying drawings and the attached description.

The present invention relates to an overcap, for an aerosol container, being closed at a first end and being opened at an opposed end thereof, and the open end of said overcap being defined by an annular skirt; an inwardly facing surface of said annular skirt being provided with at least one rib for engaging an outwardly facing surface of a mounting cup; and said annular skirt including a release mechanism for securing said overcap to the mounting cup and releasing said overcap from the mounting cup when attached thereto; wherein said release mechanism includes at least one protrusion for engaging an inwardly facing surface of the mounting cup whereby said at least one protrusion and said at least one rib releasably maintain said overcap in engagement with the mounting cup and said release mechanism facilitates disengagement of said overcap from the mounting cup when desired.

The present invention also relates to an overcap for an aerosol container in combination with an aerosol container, said aerosol container comprising a substantially closed aerosol container which is open at one end thereof and closed at an opposite end thereof, said open end of said aerosol container accommodating a mounting cup having an annular curl, an aerosol valve being supported by said mounting cup, said aerosol valve having a stem extending through said mounting cup and supporting an actuator, and said aerosol container containing an aerosol product to be dispensed; and said overcap being closed at a first end and being opened at an opposed end thereof, and the open end of said overcap being defined by an annular skirt; an inwardly facing surface of said annular skirt being provided with at least one rib for engaging an outwardly facing surface of a mounting cup; and said annular skirt including a release mechanism for securing said overcap to the mounting cup and releasing said overcap from the mounting cup when attached thereto; wherein said release mechanism includes at least one protrusion for engaging an inwardly facing surface of the mounting cup whereby said at least one protrusion and said at least one rib releasably maintain said overcap in engagement with the mounting cup and said release mechanism facilitates disengagement of said overcap from the mounting cup when desired.

The present invention finally relates to a method of securing an overcap to an aerosol container, said method comprising the steps of forming an overcap which is closed at a first end and open at an opposite end thereof, and defining the open end of said overcap with an annular skirt; providing at least one rib, for engaging an outwardly facing surface of a mounting cup, on an inwardly facing surface of said annular skirt; providing a release mechanism, for securing said overcap to the mounting cup and for releasing said overcap from the mounting cap, once attached thereto, on said annular skirt; supplying at least one protrusion, for engaging an inwardly facing surface of said mounting cup, on said release mechanism for attaching said overcap to said mounting cup via said at least one protrusion and said at least one rib; and removing said overcap from an aerosol container by a pivoting operation of said release mechanism.

BRIEF DESCRIPTION OF THE DRAWING

The invention will now be described, by way of example, with reference to the accompanying drawings in which.

DESCRIPTION OF THE PREFERRED EMBODIMENTS

Figure 1:
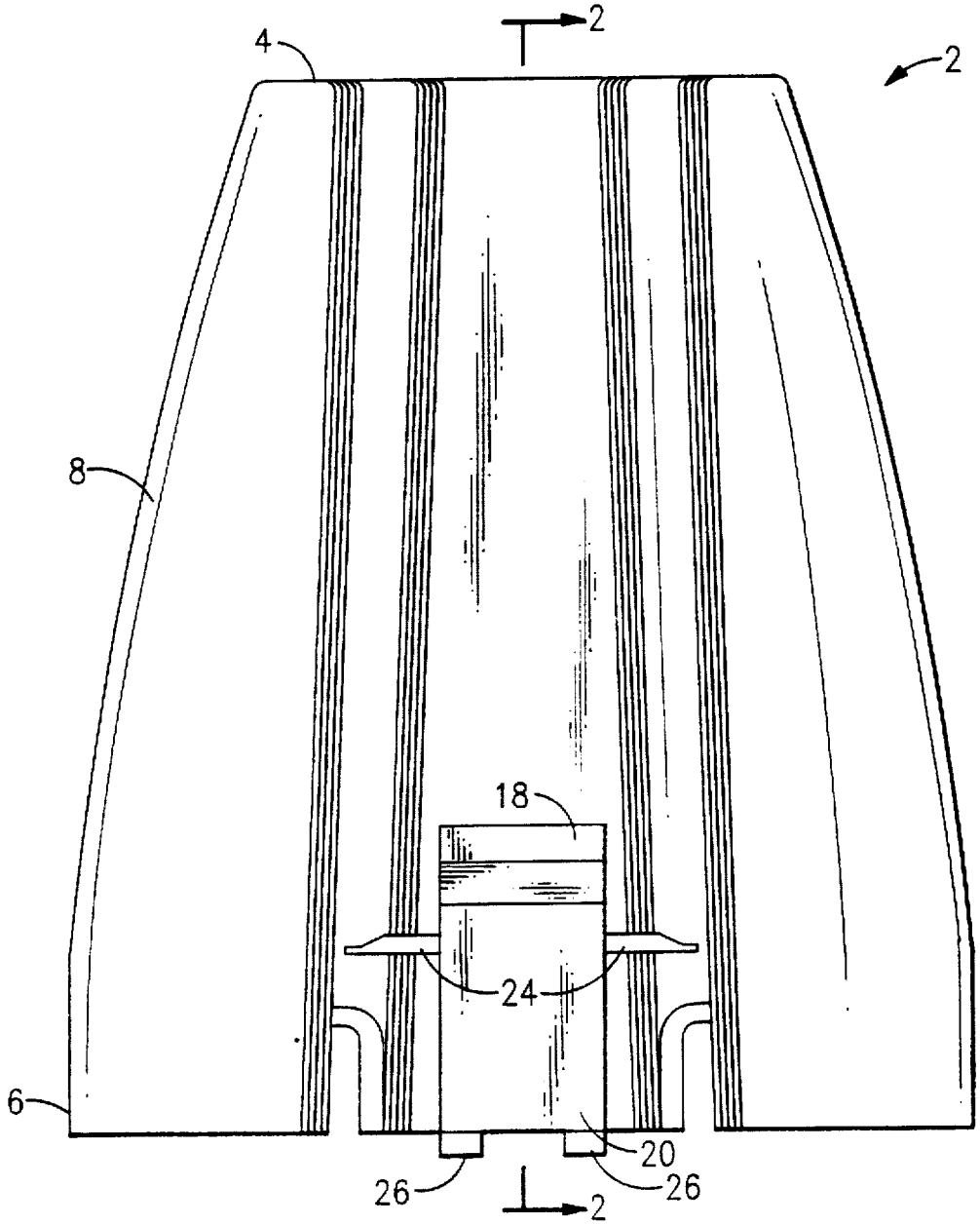
FIG. 1 is a diagrammatic front elevational view of the improved overcap according to the present invention.
Figure 2:
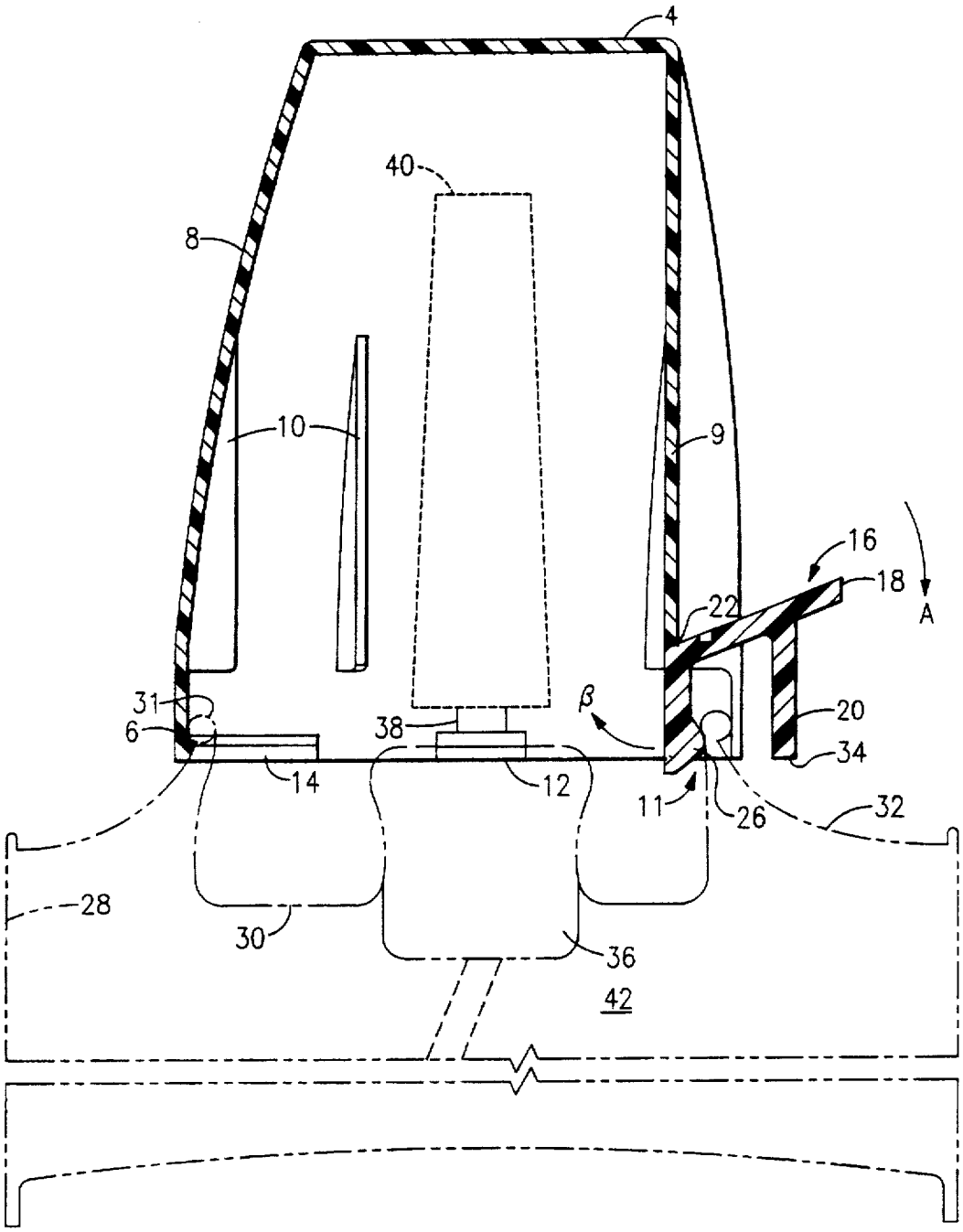
FIG. 2 is a diagrammatic cross-sectional view of the overcap of FIG. 1 along section line 2—2.
Figure 3:
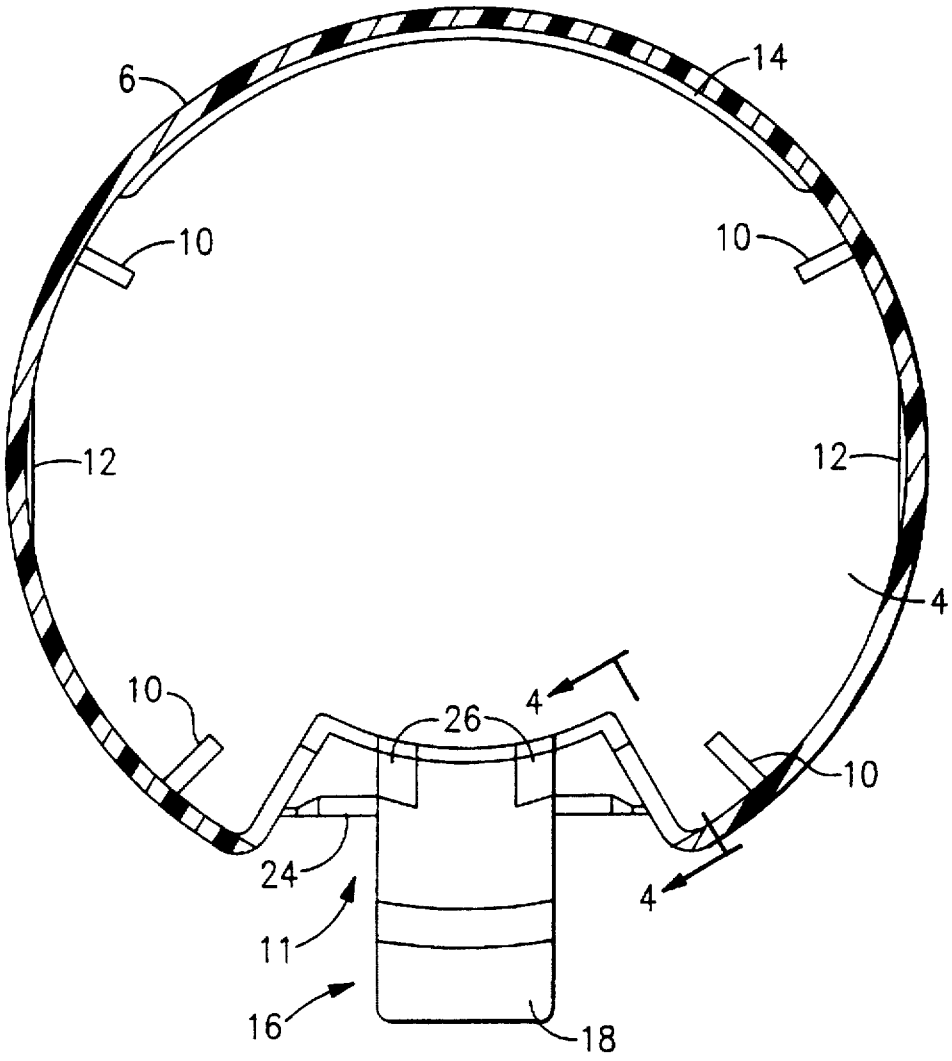
FIG. 3 is a diagrammatic bottom plan view of the overcap of FIG. 1.
Figure 4:
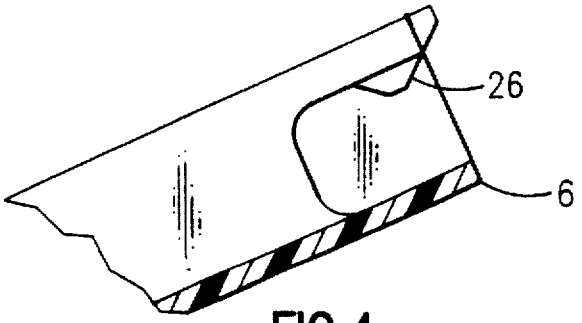
FIG. 4 is a partial cross-sectional view of the release mechanism along section line 4—4 of FIG. 3.

Turning now to FIGS. 1–4, a detailed description concerning the present invention will now be provided. As can be seen in those figures, the overcap 2 comprises a top substantially planar surface 4 being connected to an annular skirt 6 via a gradually tapering sidewall 8 whereby the overcap is closed at one end and opened at an opposite, aerosol engaging end thereof. An inwardly facing surface of the annular skirt 6 is provided with a pair of diametrically opposed small ribs 12 (FIG. 3) and one elongate rib 14 located equally spaced between the pair of small ribs 12. The pair of small ribs 12 are tapered at each opposed end thereof so that each rib has a smooth transition from the sidewall of the annular skirt 6 into a maximum dimension, measured radially of a central longitudinal axis L of the overcap 2, and then has another smooth transition back into the sidewall of the annular skirt 6 (FIG. 3).

The elongate rib 14 extends along an inner surface of the skirt over an arc distance of about 90° or so and the elongate rib 14 is located diametrically opposed to an overcap release mechanism 16. The elongate rib 14 is contoured, at each opposed end thereof, to provide a smooth transition back into the sidewall of the annular skirt 6 and avoid any sharp edges. The short rib 12 and elongate rib 14 are designed to securely grip an outer surface of a curl of a mounting cup while also facilitating removal therefrom, as desired. As can be seen in FIG. 2, the ribs 12, 14 each have a roughly semicircle shaped transverse cross-section to assist with gripping and release of the rib from the mounting cup curl.

A plurality of reinforcing ribs or members 10 are provided on the inwardly facing surface of sidewall 8. The longitudinal ribs or members 10 extend substantially parallel to the central longitudinal axis L of the overcap 2 and project radially inward from the sidewall 8. As can be seen in FIG. 3, four (4) reinforcing ribs or members 10 are shown in this embodiment. It is to be appreciate that the number and/or spacing of the reinforcing ribs or members can vary, from application to application, depending upon the overcap reinforcing requirements.

The release mechanism 16 is hinged to the remainder of the overcap, at location 22, and it is preferred that the release mechanism 16 will not become dislodged or separated from the remainder of the overcap 2 even after repeated use of the release mechanism 16. The overcap release mechanism 16 comprises an outwardly projecting tab 18 which extends from the annular skirt 6 radially outwardly at a small angle, e.g. 20° or so, with respect to the longitudinal axis L. The tab 18 supports a downwardly projecting leg 20 intermediate its elongate length. The leg 20 extends substantially parallel to the longitudinal axis L of the overcap 2 and a further discussion concerning the function of the leg 20 will be provided below.

A pair of frangible members 24 interconnect an intermediate portion of the tab 18 with the overcap 2. The frangible members 24 function as tamper-proof indicators of the overcap 2. That is, as the tab 18 is utilized to release the overcap 2 from the aerosol container, a downward pivoting motion of the overcap (in the direction of arrow A, as can be seen in FIG. 2) causes the frangible members 24 to stretch and break thereby indicating that the overcap 2 has been removed from the aerosol container 28 at least once. Accordingly, a consumer can easier inspect the overcap 2 visually, once it has been attached to an aerosol container 28 by a manufacturer, to determine any evidence of tampering which is indicated by one or both broken frangible members 24.

As can be seen in FIGS. 2 and 3, the sidewall 8 is recessed in an area 11 supporting the release mechanism 16. The recessed area 1 is formed by a portion of the sidewall 9 which extends substantially parallel to the longitudinal axis L of the overcap being interconnected to the remainder of the sidewall 8 by a pair of lateral surfaces which extends substantially radially. The lower portion of the release mechanism 16, supported in the recessed area, accommodates a pair of outwardly facing spaced apart protrusions 26 which are designed to engage with an inwardly facing surface of the mounting cup curl 31. The pair of protrusions 26, along with the pair of small ribs 12 and the elongate rib 14, cooperate with the mounting cup curl 31 to maintain the overcap 2 in engagement with an aerosol container 28. It is to be appreciated that the overcap 2 may be at somewhat of an elevated temperature when it is initially installed or attached to a mounting cup 30 of an aerosol container 28 at a manufacturing facility. Once the temperature of the overcap 2 sufficiently cools, however, it is then not possible to remove the overcap 2 from the aerosol container 28 unless one or both frangible members 24 are broken.

As can be seen in FIG. 2, the overcap 2 according to the present invention sandwiches the curl 31 of the mounting cup between an inwardly facing surface of the skirt 6 and the pair of protrusion members 26. Accordingly, the right hand portion of the overcap 2, as can be seen in FIG. 2, sandwiches a portion of the mounting cup curl 31 while the left hand portion of the overcap 2 is retained by the three ribs engaging with an outwardly facing surface of the curl 31 of the mounting cup 30.

When it is desired to remove the overcap 2 from the aerosol container 28, a user places one or more of his fingers, e.g. a thumb, upon a top surface of the tab 18. As the user biases the tab 18 downwardly, in the direction of arrow A, toward the aerosol container 28, a bottom surface 34 of leg 20 is brought into contact with an outwardly facing surface of the dome 32 of the aerosol container 28. The leg 20 functions as a fulcrum thereby prying upward, i.e. in a direction away from the aerosol container 28, the right hand side of the overcap 2 (as can be seen in FIG. 2). This pivoting motion of release mechanism 16, about hinge 22, also causes the two protrusions 26 to be biased radially inwardly and upwardly (in the direction of arrow B) out of engagement with an inner surface of the mounting cup 30 thereby releasing the right hand portion of the overcap 2 (as can be seen in FIG. 2) from the mounting cup curl 31 and facilitating the fulcrum action. Once the two protrusions 26 have cleared the inwardly facing surface of the mounting cup curl 31, the two inwardly facing smaller ribs 12 then slide over an outwardly facing surface of the mounting cup curl 31 and are released therefrom. Consequently, the overcap 2 is substantially completely removed from the mounting cup 30 as the elongate rib 14, which engages with an outwardly facing surface of the mounting cup curl 31, is the only remaining element securing the mounting cup to the overcap 2, i.e. the elongate rim 14 is insufficient by itself to maintain the overcap 2 in engagement with the mounting cup curl 31.

Once a desired quantity of product is dispensed from the aerosol container 28, the overcap 2 is re-attached to the mounting cup 30. This is achieved by placing the overcap 2, open end first, on top of the mounting cup 30 and biasing or forcing the overcap 2 toward the aerosol container 28 in a direction substantially along the longitudinal axis L of the aerosol container 28. Assuming that the release mechanism 16 has not been torn or broken away from the overcap 2, the two protrusions 26 are biased slightly radially inwardly and upwardly, in the direction of arrow B, until they clear the curl 31 of the mounting cup 30. In addition, the short and elongate ribs 12, 14 slide over the exterior surface of the curl 31 of the mounting cup 30 and engage with an underside thereof to maintain the overcap 2 in engagement with the mounting cup 30. It is to be noted that the circular shape of the annular skirt 6 may be deformed slightly both during release from and re-attachment of the overcap 2 to the mounting cup curl 31.

As can be seen in FIG. 2, the elongate rib 14 only projects radially inwardly a small distance, e.g. a about 1/64 of an inch or so. This is due to the fact that the annular skirt has a fairly close tolerance with the curl 31 of the mounting cup 30. In the event that the tolerances between the annular skirt 6 and the curl 31 of the mounting cup 30 vary significantly, it is to be noted that the height or thickness of the short and elongate ribs 12, 14 will be appropriately increased to insure that they adequately retain the overcap 2 on the mounting cup 30, as desired.

It is to be appreciated that other types of release arrangements or mechanisms, which function as a fulcrum to remove an overcap, are considered within the spirit and scope of the present invention. In addition, the number and amount of inwardly facing ribs, accommodated by the annular skirt 6, can vary from application to application. However, it is preferred that the rib(s) be located within an arc that extends no more than about halfway, e.g. preferably 195° or less, around the periphery of the annular skirt 6 and this arc should be located diametrically opposed to the release mechanism 16. This insures that, even if the release mechanism 16 is removed or torn away from the overcap 2 during use, the inwardly facing ribs 12, 14 are located at positions which are sufficient to retain the overcap 2 on the mounting cup 30 and facilitate removal therefrom by merely grasping and prying the overcap 2 away from the mounting cup 30 with minimal force, thereby causing the ribs to slide over the curl 31 of the mounting cup 30 and release the overcap 2 therefrom. As the release mechanism is not securing the right hand portion of the overcap 2 (see FIG. 2), the right hand portion can be readily raised and this facilitates release of the two short ribs from the mounting cup 30.

The aerosol container generally comprises (FIG. 2) a substantially closed aerosol container 28 which is open at one end thereof and closed at an opposite end thereof. Said open end of said aerosol container accommodates a mounting cup 30 having an annular curl 31, and an aerosol valve 36 is supported by said mounting cup 30. Said aerosol valve 36 has a stem 38 extending through said mounting cup 30 and supporting an actuator 40, and said aerosol container containing an aerosol product 42 to be dispensed.

Since certain changes may be made in the above described improved overcap, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. An overcap, for an aerosol container, being closed at a first end and being opened at an opposed end thereof, and the open end of said overcap being defined by an annular skirt;

an inwardly facing surface of said annular skirt being provided with at least one rib for engaging an outwardly facing surface of a mounting cup; and said annular skirt including a release mechanism for securing said overcap to the mounting cup and releasing said overcap from the mounting cup when attached thereto;

wherein said release mechanism includes at least one protrusion for engaging an inwardly facing surface of the mounting cup whereby said at least one protrusion and said at least one rib releasably maintain said overcap in engagement with the mounting cup and said release mechanism facilitates disengagement of said overcap from the mounting cup when desired.

2. An overcap for an aerosol container according to claim 1, wherein said overcap includes at least one reinforcing member for reinforcing a sidewall of said overcap.

3. An overcap for an aerosol container according to claim 2, wherein at least four reinforcing members are provided on an inwardly facing surface of said overcap.

4. An overcap for an aerosol container according to claim 1, wherein said release mechanism further includes a tab extending radially outwardly from said overcap, said tab supports a leg, intermediate a length of said tab, which is positioned to engage with a dome supporting the mounting cup, and said leg is located to bias a portion of said overcap, adjacent said release mechanism, out of engagement with the mounting cap to facilitate removal of said overcap from the mounting cup during a downward pivoting movement of said tab.

5. An overcap for an aerosol container according to claim 1, wherein said at least one rib is located diametrically opposed to said release mechanism.

6. An overcap for an aerosol container according to claim 5, wherein said skirt include a pair of opposed ribs, and said pair of opposed ribs are each spaced a substantially equal distance from both said at least one rib and said release mechanism.

7. An overcap for an aerosol container according to claim 1, wherein said release mechanism includes a pair of inwardly facing protrusions.

8. An overcap for an aerosol container according to claim 6, wherein said at least one rib extends over an arc distance of about 90°.

9. An overcap for an aerosol container according to claim 6, wherein said at least one rib and said pair of opposed ribs are all located within an arc that extends about halfway around an inner periphery of said annular skirt.

10. An overcap for an aerosol container according to claim 1, wherein at least one frangible member interconnects said release mechanism with said overcap to indicate tampering.

11. An overcap for an aerosol container according to claim 4, wherein a pair of frangible members interconnect said overcap with said tab to indicate tampering.

12. An overcap for an aerosol container according to claim 1, wherein a recessed area is formed in said overcap and said release mechanism is pivotably hinged to a sidewall which forms said recessed area.

13. An overcap for an aerosol container according to claim 12, wherein said sidewall of said recessed area extends substantially parallel to a longitudinal axis of said overcap.

14. An overcap for an aerosol container in combination with an aerosol container, said aerosol container comprising a substantially closed aerosol container which is open at one end thereof and closed at an opposite end thereof, said open end of said aerosol container accommodating a mounting cup having an annular curl, an aerosol valve being supported by said mounting cup, said aerosol valve having a stem extending through said mounting cup and supporting an actuator, and said aerosol container containing an aerosol product to be dispensed; and said overcap being closed at a first end and being opened at an opposed end thereof, and the open end of said overcap being defined by an annular skirt;

an inwardly facing surface of said annular skirt being provided with at least one rib for engaging an outwardly facing surface of a mounting cup; and said annular skirt including a release mechanism for securing said overcap to the mounting cup and releasing said overcap from the mounting cup when attached thereto;

wherein said release mechanism includes at least one protrusion for engaging an inwardly facing surface of the mounting cup whereby said at least one protrusion and said at least one rib releasably maintain said overcap in engagement with the mounting cup and said release mechanism facilitates disengagement of said overcap from the mounting cup when desired.

15. A method of securing an overcap to an aerosol container, said method comprising the steps of:

forming an overcap which is closed at a first end and open at an opposite end thereof, and defining the open end of said overcap with an annular skirt;

providing at least one rib, for engaging an outwardly facing surface of a mounting cup, on an inwardly facing surface of said annular skirt;

providing a release mechanism, for securing said overcap to the mounting cup and for releasing said overcap from the mounting cap, once attached thereto, on said annular skirt;

supplying at least one protrusion, for engaging an inwardly facing surface of said mounting cup, on said release mechanism for attaching said overcap to said mounting cup via said at least one protrusion and said at least one rib; and removing said overcap from an aerosol container by a pivoting operation of said release mechanism.

* * * * *